US006409026B2

(12) United States Patent
Watanabe

(10) Patent No.: US 6,409,026 B2
(45) Date of Patent: Jun. 25, 2002

(54) SHOWCASE ASSEMBLY UNIT FOR SHOWCASE STRUCTURE

(75) Inventor: Mikio Watanabe, Tokyo (JP)

(73) Assignee: Kid Co., Ltd., Tokyo (JP)

( * ) Notice: Subject to any disclaimer, the term of this patent is extended or adjusted under 35 U.S.C. 154(b) by 0 days.

(21) Appl. No.: 09/793,136

(22) Filed: Feb. 27, 2001

(30) Foreign Application Priority Data

Feb. 29, 2000 (JP) ..... 2000-054727

(51) Int. Cl.[7] ..... B65G 13/00; A47F 1/00

(52) U.S. Cl. ..... 211/59.2; 312/71; 198/35 R; 198/35 C

(58) Field of Search ..... 211/59.2, 151; 312/71; 193/35 R, 35 C

(56) References Cited

U.S. PATENT DOCUMENTS 842,155 A * 1/1907 Mathews
1,406,228 A * 2/1922 Riedel
1,795,192 A * 3/1931 York
2,593,089 A * 4/1952 Barry ..... 193/35 R
2,696,283 A * 12/1954 Barry ..... 193/35 R
2,964,154 A * 12/1960 Erickson
3,509,978 A * 5/1970 Bedford
4,067,428 A * 1/1978 Shuttleworth ..... 193/35 R
4,681,203 A * 7/1987 Korynylak ..... 193/35 R
5,474,412 A * 12/1995 Pfeiffer et al. ..... 193/35 R
5,996,764 A * 12/1999 Barkley ..... 193/35 R
6,073,743 A * 6/2000 Mefford ..... 211/59.2 X
6,089,385 A * 7/2000 Nozawa ..... 211/59.2

* cited by examiner

*Primary Examiner*—Robert W. Gibson, Jr.
(74) *Attorney, Agent, or Firm*—Wenderoth, Lind & Ponack, L.L.P.

(57) ABSTRACT

A showcase assembly unit for a showcase structure is disclosed, which includes a roller support frame and a plurality of parallel sets of rollers mounted on the roller support frame, wherein the rollers in each set of rollers are mounted rotatably and arranged one after another from the rear end toward the front end of the roller support frame. A plurality of individual articles, such as canned foods or drinks, may be placed across two or more parallel sets of rollers and are capable of moving one by one from the rear end toward the front end of the roller support frame. In the showcase assembly unit for the showcase structure according to the present invention, each roller has a specific width that is smaller than a dimension of the bottom of a particular article across the roller, and each of the rollers in each set is axially offset relative to a corresponding one of the rollers in each adjacent set.

4 Claims, 6 Drawing Sheets

SHOWCASE ASSEMBLY UNIT FOR SHOWCASE STRUCTURE

BACKGROUND OF THE INVENTION

1. Field of the Invention

The present invention relates to a showcase structure on which goods or articles such as foods or drinks packed in cans or bottles, i.e., canned foods or drinks and bottled drinks, etc. are placed for sale in shops, such as supermarkets, drugstores, convenience stores and the like. Usually, such a showcase structure comprises a roller support frame that is arranged so as to have a down-slope from the rear end toward the front end of the roller support frame, and on which a plurality of parallel sets of rollers are mounted. The rollers in each parallel set of rollers are mounted rotatably on the roller support frame and arranged one after another from the rear end toward the front end of the roller support frame. Individual articles, such as canned drinks, may be placed across two or more parallel sets of the rollers so that the articles can be moved or slid down one by one along those rollers from the rear end toward the front end.

More specifically, the present invention relates to a showcase assembly unit for such a showcase structure.

2. Prior Art

FIG. 7 represents a showcase structure that is installed in shops such as supermarkets, drugstores, convenience stores and the like, and FIG. 8 shows a conventional showcase assembly unit that is designed for use with the showcase structure shown in FIG. 7.

As shown in FIG. 8, the showcase assembly unit includes a roller support frame 1 that is arranged so as to have a down-slope from the rear end toward the front end, and on which a plurality of parallel sets of rollers A, B, etc. are mounted across the roller support frame 1. The rollers in each set A, B are rotatably mounted and arranged one after another from the rear end toward the front end. And the rollers in each set A, B are arranged in parallel with the rollers in each adjacent set across the roller support frame. For example, as shown in FIG. 8 and FIG. 10, set A includes a plurality of rollers 2*a*, 2*b*, etc. arranged one after another from the rear end toward the front end of the roller support frame 1, and set B includes a plurality of rollers 12*a*, 12*b*, etc. arranged similarly and in parallel with the set of rollers A across the roller support frame 1.

The rollers in each set A, B, such as the roller 2*a*, etc. are each mounted rotatably in the respective directions indicated by arrows 41 or 42 in FIG. 9 so as to permit the articles thereon to roll or slide down one by one toward the front end.

Then, when a consumer picks up an article that is shown at the foremost end 45, as shown by an arrow 46 in FIG. 8, from the articles placed in series on a particular set of rollers, such as the sets A and B in this case, in the showcase structure in FIG. 7, the articles 47 that follow the article 45 just picked up will automatically move down toward the front end one by one along the rollers as shown by arrow 48 in FIG. 8.

It may be seen from FIG. 10 that the conventional showcase assembly unit for the showcase structure includes several parallel sets of rollers A, B, C, D that are mounted across the showcase assembly unit, in which the respective rollers in any two adjacent sets are axially aligned with each other. For example, each of the rollers 2*a*, 2*b*, 2*c*, etc. in set A is axially aligned with a corresponding one of the rollers 12*a*, 12*b*, 12*c*, etc. in set B.

FIG. 9 represents the conventional showcase assembly unit for the showcase structure shown in FIGS. 8 and 10, which shows the sequence of rollers as viewed from the side to explain how a particular article, such as a canned drink, moves (slides) on the rollers. FIG. 9 also shows, on an enlarged scale, how the bottom of the article makes contact with the top of the sequence of the rollers.

It may be noticed, as shown in FIG. 10 that each of the rollers in set A is axially aligned with a corresponding one of the rollers in set B, which is parallel to set A. For example, roller 2*a* in set A is axially aligned with its corresponding roller 12*a* in set B. Similarly, roller 2*b* in set A is axially aligned with its corresponding roller 12*b* in set B.

As viewed from the side of the roller sequence as shown in FIG. 9, roller 12*a* in set B is hidden behind roller 2*a* in set A, and roller 12*b* is hidden behind roller 2*b* in set A.

As shown in FIG. 9, there is a large gap S that is created on the top between adjacent rollers 2*a* and 2*b* in set A, as well as between adjacent rollers 12*a* and 12*b* in set B, which are not seen behind rollers 2*a* and 2*b*.

Thus, when an article 5, such as a canned drink, is moving along the rollers in the parallel sets A and B as shown in FIG. 10, the article must overcome the large gap S on the top between the rollers 2*a* and 2*b*, between the rollers 12*a* and 12*b*, between the rollers 2*b* and 2*c*, and between the rollers 12*b* and 12*c*, etc.

This gap S (FIG. 9) may have a different size, depending on the diameters of the adjacent rollers, for example, rollers 2*a* and 2*b* and rollers 12*a* and 12*b*, and also depending on the interval between the outer surfaces of the adjacent rollers, for example, between the outer surfaces of rollers 2*a* and 2*b*, etc.

In any case, as each of the rollers 2*a*, 2*b*, 2*c*, etc. in set A is axially aligned with a corresponding one of the rollers 12*a*, 12*b*, 12*c*, etc. in set B as shown in FIG. 10, the gap S on the top between the respective adjacent rollers in the parallel sets of rollers, for example, rollers 2*a* and 2*b* in set A and rollers 12*a* and 12*b* in set B, must be large as viewed from the side in FIG. 9.

When an article 5 is moving down along the rollers, as indicated by an arrow 48 in FIG. 8, it may cause a jolting motion, thereby producing a large noise and much friction each time it moves past the gap S between the adjacent rollers.

When the article 5 is moving from the position shown by phantom lines 5*a* to the position shown by phantom lines 5*b* in FIG. 9, it cannot be maintained at a constant level or height, because the large gap S exists between adjacent rollers 2*a* and 2*b* in set A as well as between adjacent rollers 12*a* and 12*b* in set B (not seen), as viewed from the side in FIG. 9. Thus, each time the article 5 moves past the large gap S, it may cause a jolting motion and produce a large noise. It may be seen in FIG. 9 that the article is higher when it is placed in the position 5*b* than when it is placed in the position 5*a*.

It may be understood from the forgoing description that when a number of individual articles, that are placed one after another on the rollers from the rear end toward the front end of the roller support frame, are moving down one by one, as shown by arrow 48 in FIG. 8, the individual articles may receive a force that prevents them from moving forward, depending on the particular shape of the bottom of the article and the particular physical size of the article.

This problem may be solved by two possible ways. One way is to incline the roller support frame more greatly so that the articles can overcome the force that resists their movement. The other way is to make the outer diameter of each individual roller as small as possible and to make the interval between the outer surfaces of adjacent rollers as small as possible so that the gap S which is created on the top between the adjacent rollers 2*a* and 2*b*, for example, can be smaller.

In the former case, however, the articles may be moving forwardly rapidly. Thus, some adequate means must be provided for preventing any one of the following articles 47 from jumping out. Otherwise, the articles 47 that follow the foremost article 45 may exert a great force against the article 45, which makes it difficult for a consumer to pick up the article 45. For the latter case, additional manufacturing costs would be incurred, and easy maintenance would be impossible.

SUMMARY OF THE INVENTION

An object of the present invention is to solve the problems associated with the conventional showcase assembly unit for the showcase structure as described above, and therefore to propose to provide a showcase assembly unit for the showcase structure in which individual commercial articles represented by foods or drinks packed in cans or bottles, i.e., canned foods or drinks, may be placed one after another along and across the rollers so that when those articles are moved from the rear end toward the front end one by one, each article can be moved with stability while it is maintained at a constant height, without causing a jolting motion or producing a large noise, and with less frictional force.

In order to attain the above object, the showcase assembly unit for the showcase structure proposed by the present invention may comprise the following elements.

Generally, the showcase assembly unit includes a roller support frame, and a plurality of parallel sets of rollers mounted on the roller support frame. The rollers in each set are rotatably mounted on the roller support frame and arranged one after another from the rear end toward the front end of the roller support frame.

More specifically, a first set of rollers is mounted on the roller support frame. The rollers in this first set of rollers are rotatably mounted on the roller support frame and arranged one after another from the rear end toward the front end of the roller support frame. A second set of rollers is mounted on the roller support frame in parallel with and adjacent to the first set of rollers. The rollers in this second set of rollers are rotatably mounted on the roller support frame and arranged one after another from the rear end toward front end of the roller support frame. Other sets of rollers are also mounted in the same manner as that for the first and second sets of rollers. Individual articles, such as foods or drinks packed in cans or bottles, i.e., canned foods or drinks, and bottled drinks, etc., may be placed across the adjacent sets of rollers so that the individual articles can move down one by one along the rollers toward the front end of the roller support frame.

Each of the rollers in each of the plurality of parallel sets of rollers has a predetermined width that is smaller than a dimension of the bottom of a particular individual article that extends across each of the rollers, so as to permit the individual articles to be placed across two or more rollers in the sets that are adjacent to each other. And, each of the rollers in each of adjacent parallel sets of rollers is axially offset relative to a corresponding one of the rollers in the other of the adjacent parallel sets, in the direction from the rear end toward the front end of the roller support frame.

A single article, such as a canned drink or bottled drink, may be placed across two or more adjacent parallel sets of rollers as each roller is less wide than the dimension of the bottom of the article that extends across the rollers, and is capable of moving across and along these rollers toward the front end of the roller support frame.

More specifically, for sets of rollers A and B which are adjacent to each other, for example, each of rollers 2*a*, 2*b*, 2*c*, etc. in set A is axially offset relative to a corresponding one of rollers 12*a*, 12*b*, 12*c*, etc. in set B.

When those sets of rollers A and B are viewed from the side, the rollers 12*a*, 12*b*, 12*c*, etc. in set B are visible although they are placed behind the rollers 2*a*, 2*b*, 2*c*, etc. in set A, as shown in FIG. 2(*a*). Thereby, a gap S that is defined on the top between any two corresponding rollers of adjacent sets, in the direction from the rear end toward the front end of the roller support frame as viewed from the side can be smaller than a similar gap found in the prior art as shown in FIG. 9.

Then, when a particular article that is placed across the rollers in the adjacent sets A and B is moving forward along the rollers, passing over the gap S defined on the top between the two corresponding rollers in the direction from the rear end toward the front end of the roller support frame, the article can be moved while it is maintained at a constant height because the gap S is smaller and the article is supported by the outer top sides of any two adjacent rollers 2*a*, 2*b*, 2*c*, etc. in set A, and by the outer top sides of any two adjacent rollers 12*a*, 12*b*, 12*c*, etc. in set B that is adjacent to set A. As the article can be moved in this way, it will not be jolted or produce any vibrations or large noise.

Each of the rollers in one set, such as set A in this case, may be axially offset relative to a corresponding one of the rollers in the other set, such as set B, by a distance that is equal to one half to one fourth the interval between two adjacent rollers in set A or B. as measured from axis to axis.

The offset of each roller in one set relative to a corresponding roller in the other set may be adjusted, depending on the diameter of the roller or the dimension of the bottom of a particular article that extends across the rollers.

When the offset is set to a value that is equal to one half the axis-to-axis interval between the two adjacent rollers, for example, the article can be moved with stability and without causing any appreciable jolting motion or producing any large noise.

If the offset is set to any smaller value, such as one third, one fourth or much smaller, the article can be moved with less jolting motion and less noise. In any event, the offset value should be determined by considering manufacturing costs and ease of maintenance. In this respect, the offset should preferably be set to any value between one half and one fourth.

Referring now to FIG. 5, the roller support frame 1 is described in detail. The roller support frame 1 includes a lower bearing segment 3 and an upper bearing segment 4 that is mounted on the lower bearing segment 3.

More specifically, the lower bearing segment 3 has a flat surface on its upper side that supports each parallel set of rollers so that respective roller shafts can be maintained in the same plane. The upper bearing segment 4 has recesses for accepting the respective roller shafts, which are located on the lower side of the upper bearing segment 4 facing the upper side of the lower bearing segment 3 and are positioned to face the flat surface on the lower bearing segment 3.

Preferably, each recess on the upper bearing segment 4 should have a depth that is at least equal to the diameter of each roller shaft, and should have a bottom that is curved to conform to the outer peripheral surface of each roller shaft.

In this way, each of the roller shafts in each parallel set may be supported so that the roller shafts can be placed in the same plane. Thus, the rollers can have identical heights that meet the practical allowable precision requirements. As such, the articles can be moved without causing any jolting motion or vibrations.

As each roller shaft is supported by the flat surface of the lower bearing segment, the lower side (weight transmitting side) of each roller shaft can make contact with the flat surface of the lower bearing segment both linearly and circularly. This is substantially equivalent to linear contact, which may reduce rotational friction considerably. Therefore, the contact area may be reduced accordingly, which prevents dust from building up at the contact area.

As each roller shaft is supported by the flat surface of the lower bearing segment as described above, each recess that is provided on the lower side of the upper bearing segment for accepting the roller shafts may only serve as the positioning means for the rollers. Therefore, the recess needs not to accept the total periphery of the roller shaft. This permits the contact area between each roller shaft and the inner peripheral wall of the recess to be extremely small, which meets an object of the present invention. What is required in this case is that the recess has a depth that is equal to the diameter of each roller shaft and that the bottom of the recess is curved to conform to the outer peripheral surface of each roller shaft.

It should be understood that the present invention is not limited to any particular shape of the recess, and the recess may have the inner peripheral wall formed like a curve or angle.

One advantage of the present invention is that it permits goods or articles such as canned drinks or bottled drinks to be maintained at a constant height when they are moving along the rollers from the rear end toward the front end of the showcase assembly unit. Thus, the individual articles can be moved with stability and without causing any jolting motion or producing any large noise.

Another advantage of the present invention is that many rollers can be mounted in the same plane with high precision, and those rollers can rotate with less frictional force.

BRIEF DESCRIPTION OF THE DRAWINGS

FIG. 2(*b*) is a side elevational view of a variation of the embodiment in FIG. 1, in which the roller support frame comprising the lower bearing segment and upper bearing segment is modified, with roller shafts omitted for clarity of explanation;

FIG. 4(*b*) is a side elevational view of a variation of the embodiment in FIG. 3, in which the roller support frame comprising the lower bearing segment and upper bearing segment is modified, with roller shafts omitted for clarity of explanation;

DETAILED DESCRIPTION OF THE PREFERRED EMBODIMENTS

Referring to FIGS. 1 through 6, the embodiments of the present invention are now described in further detail.

Figure 1:
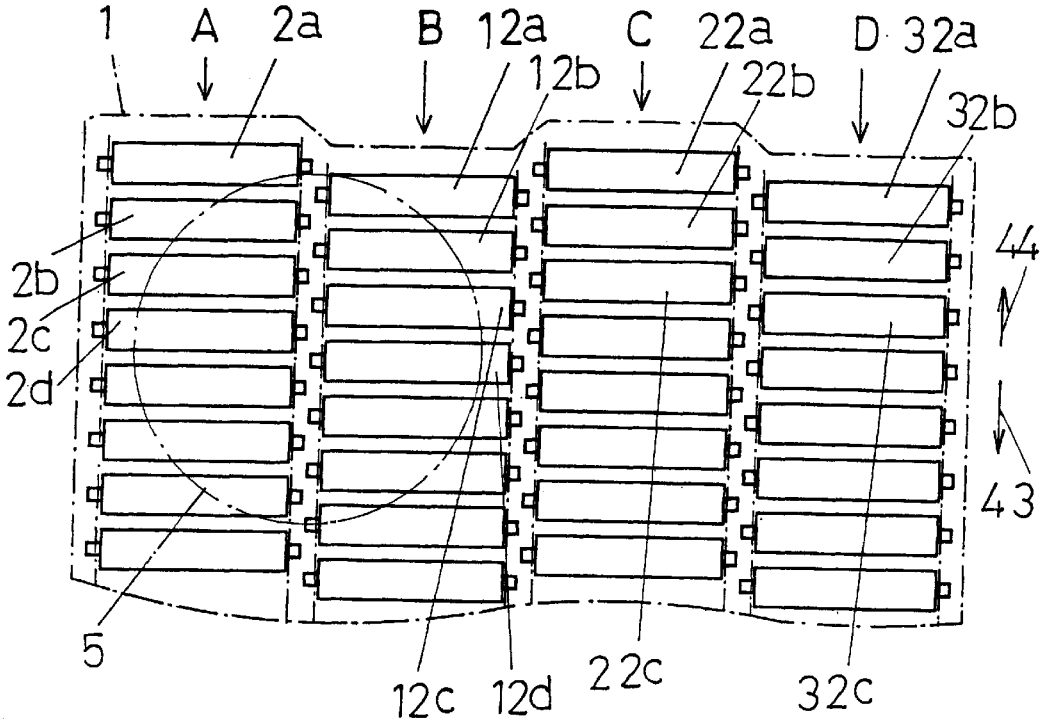
FIG. 1 is a plan view showing part of the roller arrangement according to one preferred embodiment of the present invention.

Referring first to FIG. 1, there is shown a showcase assembly unit for the showcase structure according to the present invention, which includes a roller support frame 1 and a plurality of parallel sets of rollers 2*a* to 2*d*, etc., 12*a* to 12*d*, etc., 22*a* to 22*c*, etc., 32*a* to 32*c*, etc. that are mounted on the roller support frame 1. The rollers in each set of rollers are mounted rotatably on the roller support frame 1 and arranged one after another from a rear end toward a front end of the roller support frame 1, and are parallel with the rollers of each of the adjacent sets A, B, C or D.

More specifically, the parallel sets of rollers include four sets of rollers A, B, C, and D, for example, that are arranged in parallel with each other in a direction perpendicular to the direction of the roller support frame 1 from the rear end toward the front end. Each of the sets A, B, C, and D includes a plurality of rollers 2*a* to 2*d* etc., 12*a* to 12*d* etc., 22*a* to 22*c* etc., and 32*a* to 32*c*, etc., respectively, that are rotatably mounted on the roller support frame 1 and are arranged one after another from the rear end toward the front end of the roller support frame 1.

Here, the phrase "from the rear end toward the front end of the roller support frame 1" should be understood to mean "from the top end toward the bottom end" in the plane of the drawing, as shown in FIG. 1. The phrase "the rollers 2*a*, etc. are rotatably mounted" should be understood to mean that the rollers are rotatably mounted in the respective directions shown by arrows 41 or 42 in FIG. 2(*a*).

Figure 3:
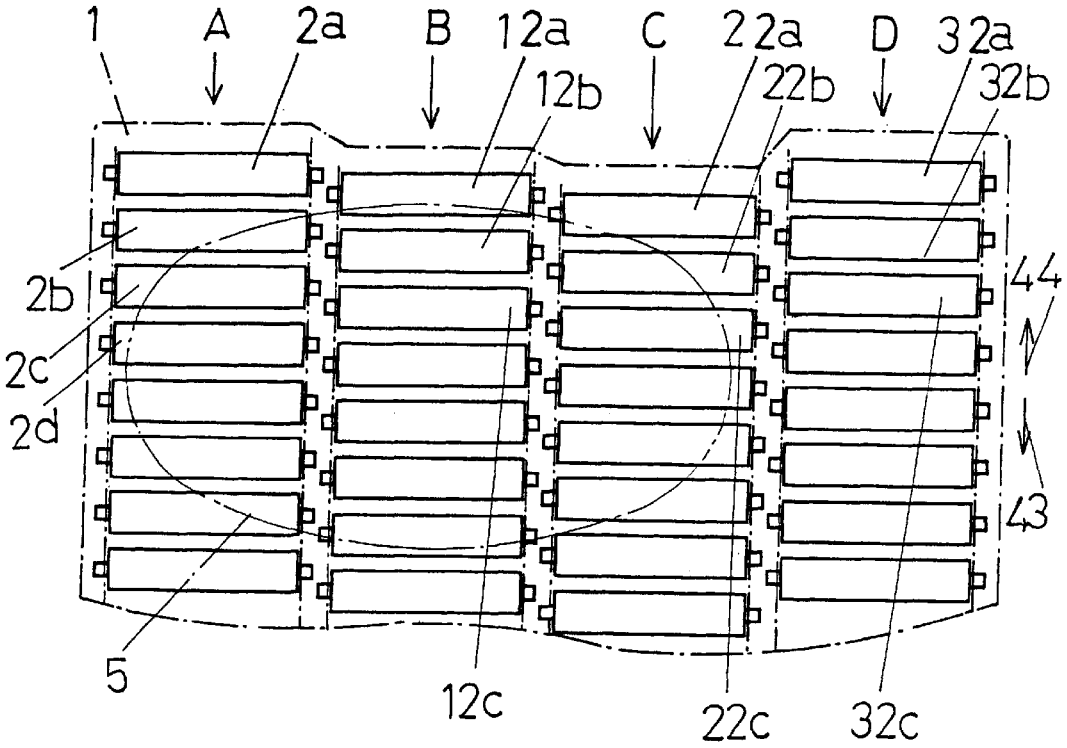
FIG. 3 is a plan view showing part of the roller arrangement according to another preferred embodiment of the present invention.

In each set of rollers A, B, C and D, the interval between any two adjacent rollers in the direction from the rear end toward the front end of the roller support frame 1 is kept constant. That is to say, as shown in FIGS. 1 and 3, the interval between the rollers 2*a* and 2*b* is as same as that of between the rollers 2*b* and 2*c*, 2*c* and 2*d*, 12*a* and 12*b*, 12*b* and 12*c*, 22*a* and 22*b*, etc.

Individual articles, such as canned foods or drinks, may be placed across two or more adjacent sets of rollers A, B, C, D, and may move or slide one by one along the rollers from the rear end toward the front end of the roller support frame 1. In FIG. 1, an article 5, as represented by phantom lines, is placed across the two parallel sets of rollers A and B, and moves toward the bottom end in FIG. 1.

When the showcase assembly unit as described above is installed in a showcase structure, it may be done so that the roller support frame 1 descends from the rear end toward the front end thereof, specifically, from the top end toward the bottom end in FIG. 1 so as to permit the individual articles to move or slide one by one along the rollers in the sets A, B, C, D from the rear end toward the front end of the roller support frame 1.

In the showcase assembly unit according to the present invention, each roller 2*a*, 12*a*, 22*a*, 32*a*, etc. has a width that is smaller than the dimension of the bottom of the article 5 that extends across the rollers.

Thus, individual articles are placed across at least two or more adjacent sets of rollers, A, B, C and D, rather than a single set of rollers, and may be moved one by one along those sets of rollers. In the example shown in FIG. 1, the article 5 is moved along the adjacent sets of rollers A and B.

In the showcase assembly unit according to the present invention, the parallel sets of rollers A, B, C and D are arranged such that each of the respective rollers 2*a* to 2*d*,etc. in set A, 12*a* to 12*d*, etc. in set B, 22*a* to 22*c*, etc. in set C, and 32*a* to 32*c* in set D is offset relative to a corresponding one of the rollers in an immediately adjacent set, in the direction from the rear end toward the front end of the roller support frame 1.

More specifically, it may be seen in FIG. 1 that for the sets of rollers A and B, which are adjacent to each other, each of the rollers 2*a*, 2*b*, 2*c*, etc. in set A is offset relative to a corresponding one of the rollers 12*a*, 12*b*, 12*c*, etc. in set B by a distance that is equal to one half the interval between any two adjacent rollers in a set, as measured from the axis of one of the adjacent rollers to the axis of the other of the adjacent rollers.

Figure 2:
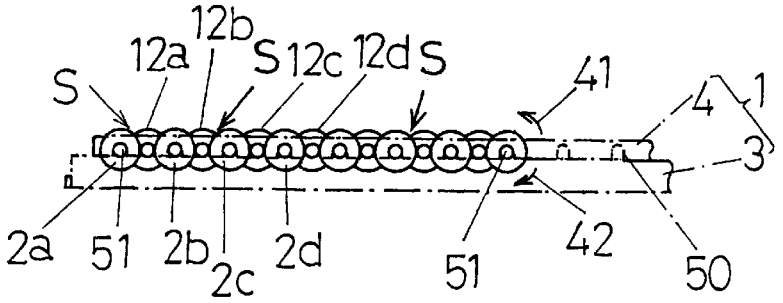
FIG. 2(*a*) is a side elevational view of the embodiment shown in FIG. 1, with some parts omitted for clarity of explanation.
Figure 2:
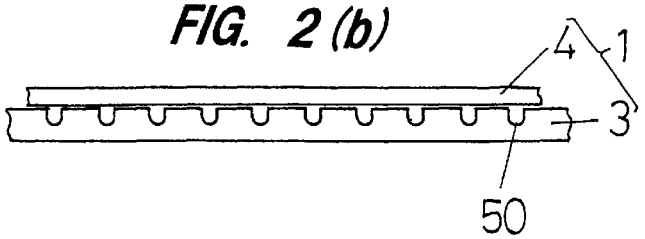

When those two sets of rollers are viewed from the side, the rollers 12*a*, 12*b*, 12*c*, 12*d* in set B are visible although they are placed behind the rollers 2*a*, 2*b*, 2*c*, 2*d* in set A, as shown in FIG. 2(*a*). For example, roller 12*a* in set B appears between rollers 2*a* and 2*b* in set A.

Figure 9:
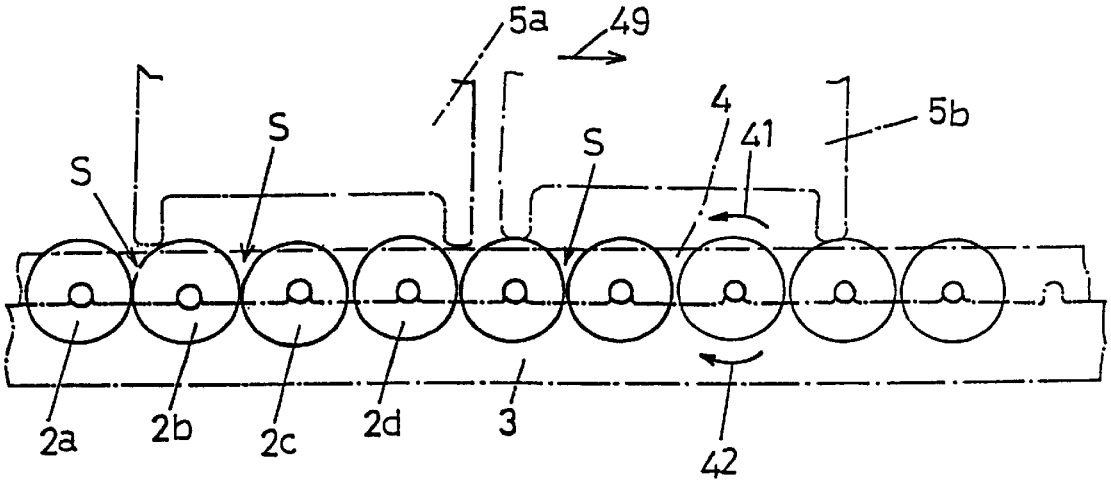
FIG. 9 (prior art)
FIG. 9 is a side elevational view that is presented to help understand how the articles are moving along the rollers in the prior art showcase assembly unit for the showcase structure.
Figure 10:
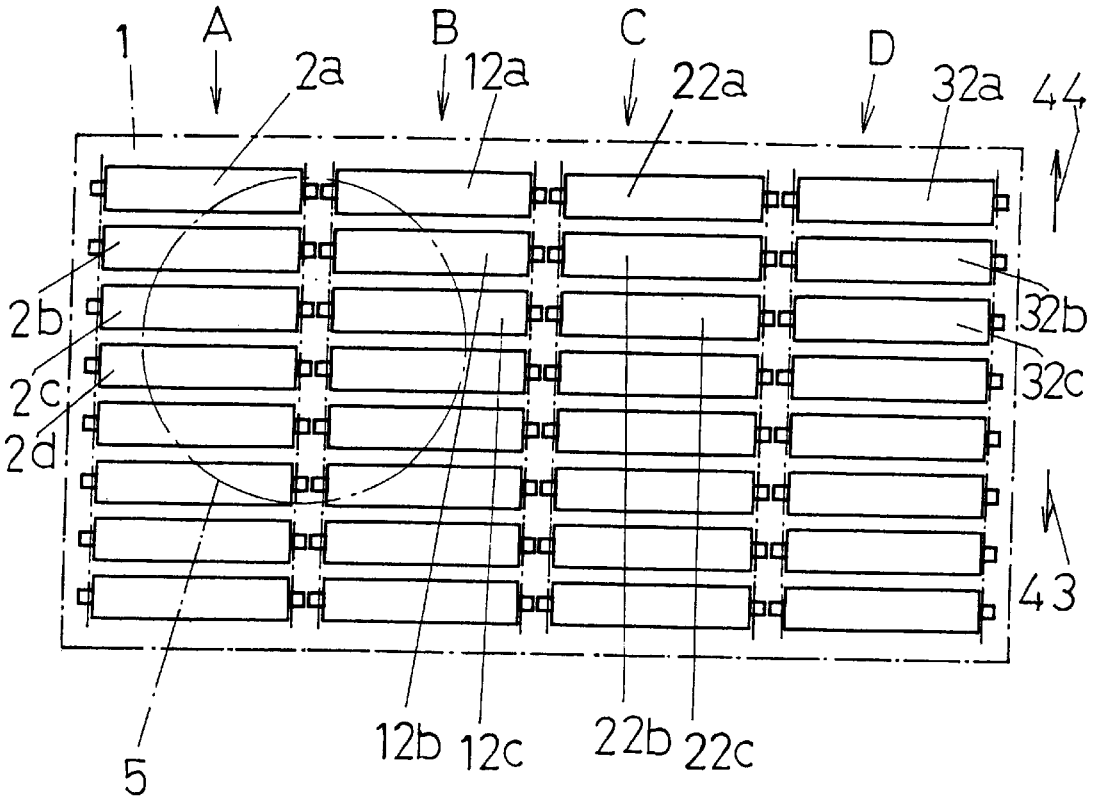
FIG. 10 (prior art)
FIG. 10 is a plan view showing part of the roller arrangement according to the prior art showcase assembly unit for the prior art showcase structure.

As viewed from the side in FIG. 2(*a*), the gap S that is defined on the top between two corresponding rollers in set A and set B is smaller than a similar gap found in the prior art shown in FIG. 9.

Figure 6:
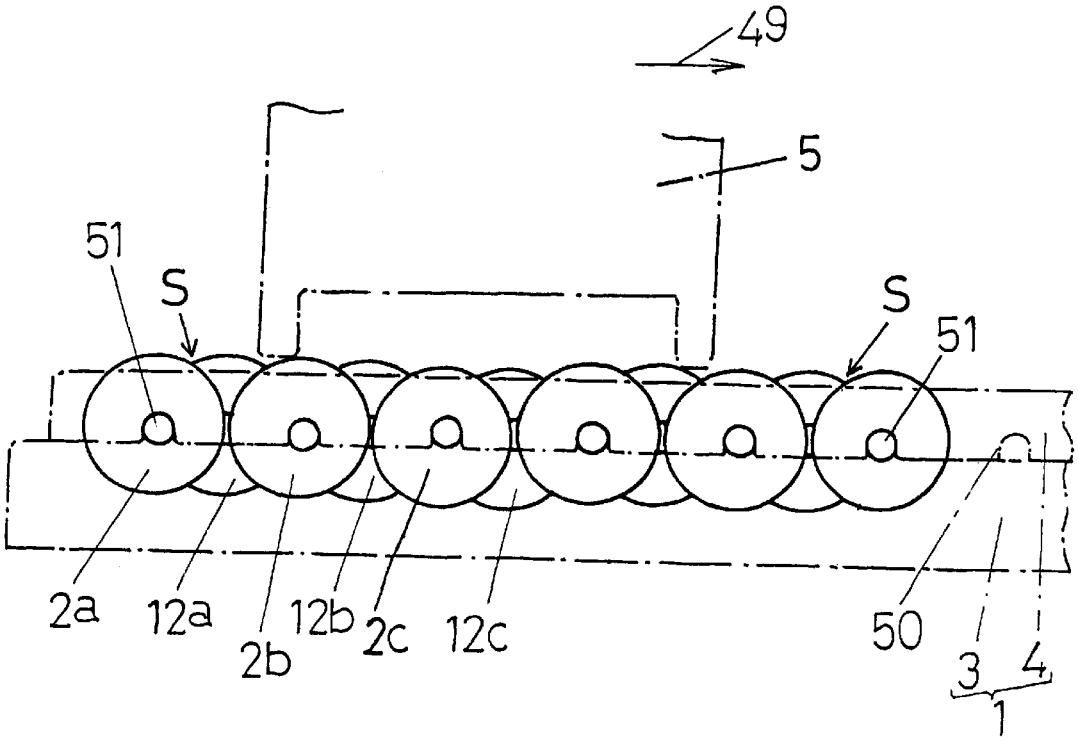
FIG. 6 is a side elevational view that is presented to help understand how the articles are moving along the rollers in the showcase assembly unit for the showcase structure according to the embodiment in FIG. 1.
Figure 7:
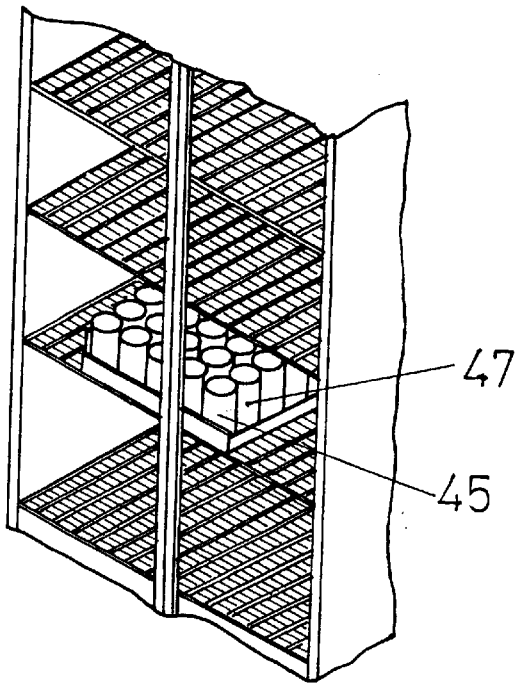
FIG. 7 is a perspective view showing the showcase structure for which the showcase assembly unit according to the present invention may be used, with some parts omitted.
Figure 8:
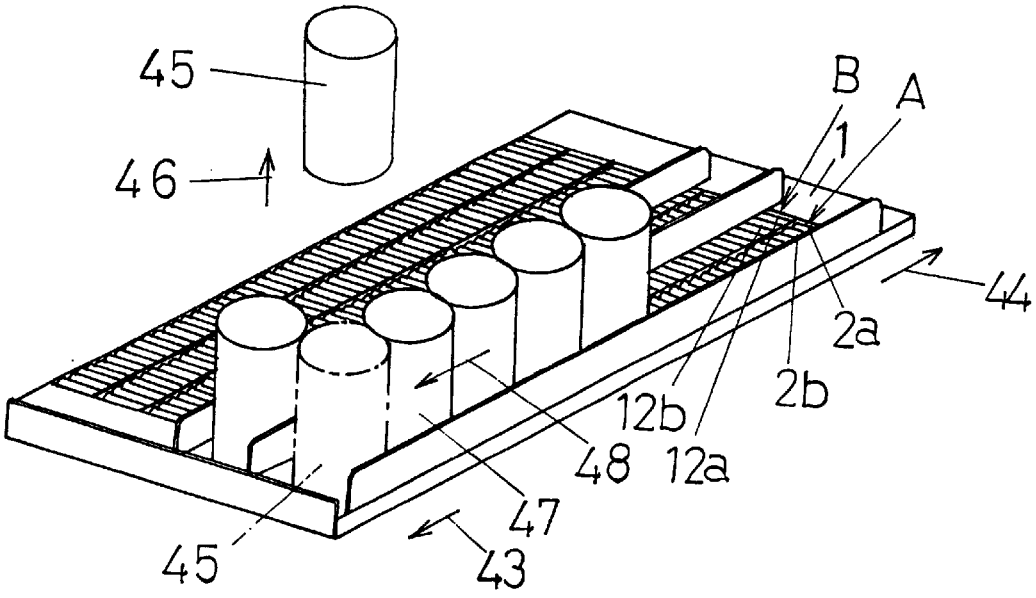
FIG. 8 (prior art)
FIG. 8 is a perspective view of the prior art showcase assembly unit in the showcase structure.

When the article 5, which is placed across the two adjacent sets of rollers A and B as shown in FIG. 1, is moving along the rollers as shown by arrow 49 in FIG. 6, it may be moved from the rear end toward the front end of the roller support frame 1 while it is maintained to be at almost a constant height or level during its entire movement. This is because the gaps S that the article 5 encounters during its movement are relatively small, and the article 5 can thus smoothly move past these gaps S. This ensures that the article 5 is supported by the outer top sides of the rollers 2*a*, 2*b*, 2*c*, 2*d*, etc. in set A as well as by the outer top sides of the rollers 12*a*, 12*b*, 12*c*, 12*d*, etc. in set B. Thus, the article 5 will not produce any jolting motion or large noise, and will not receive any extra resistance when it is moving past each gap S.

Referring again to FIG. 2(*a*), the roller support frame 1 includes a lower bearing segment 3 and an upper bearing segment 4 mounted on the lower bearing segment 3.

Figure 5:
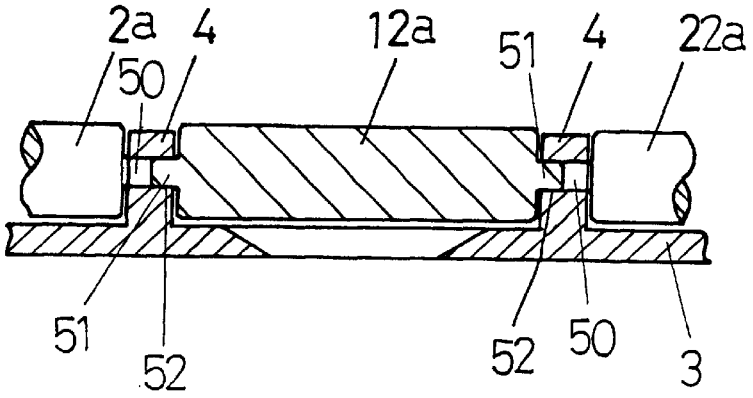
FIG. 5 is a partly enlarged sectional view that is presented to help understand how the rollers are mounted in the showcase assembly unit for the showcase structure according to the embodiment in FIG. 1.

Specifically, the lower bearing segment 3 has a flat surface 52, as shown in FIG. 5 on its upper side for supporting rotary shafts 51 for the respective rollers 2*a* to 2*d*, etc. 12*a* to 12*d*, etc., 22*a* to 22*c*, etc., 32*a* to 32*c*, etc. so that the rollers can be maintained in the same plane.

The upper bearing segment 4 has recesses 50 for accepting the roller shafts 51, which are located on the lower side of the upper bearing segment 4 facing the upper side of the lower bearing segment 3, and are provided in a position corresponding to the flat surface 52 on the lower bearing segment 3.

Each of the rotary shafts 51 for the respective rollers 2*a* to 2*d*, etc., 12*a* to 12*d*, etc., 22*a* to 22*c*, etc., 32*a* to 32*c*, etc. in the sets A, B, C, D may be supported on the flat surface 52 on the lower bearing segment 3 as if all the rotary shafts are supported in the same plane.

As each roller shaft 51 is supported on the flat surface 52 on the lower bearing segment 3, it may make linear contact with the flat surface 52. This reduces the rotational friction considerably.

Each recess 50 on the lower side of the upper bearing segment 4 may have a depth that is equal to the diameter of each roller shaft 51, and may have a bottom that is curved to conform to the outer peripheral surface of each roller shaft 51.

The embodiment shown in FIG. 2(*b*) is a variation of the embodiment shown in FIG. 2(*a*), wherein the lower bearing segment 3 has the recesses 50 on its upper side for accepting each roller shaft 51, and the upper bearing segment 4 has the flat surface on its lower side facing the lower bearing segment 3. In this case, the inner bottom wall of each recess 50 makes contact with the outer peripheral surface of each roller shaft 51, which may increase the rotational friction. However, the flat surface of the upper bearing segment 4 may act to hold down each roller shaft 51.

Figure 4:
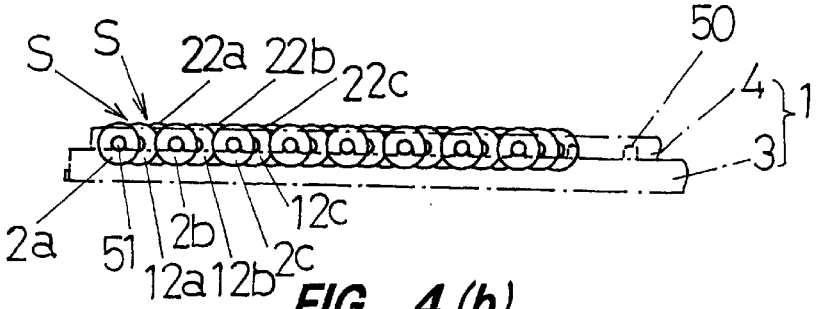
FIG. 4(*a*) is a side elevational view of the embodiment shown in FIG. 3.
Figure 4:
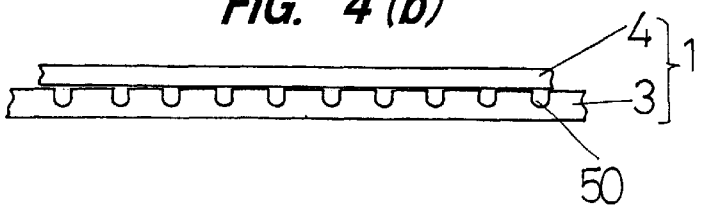

FIG. 3, FIG. 4(*a*), and FIG. 4(*b*) correspond to FIG. 1, FIG. 2(*a*), and FIG. 2(*b*), respectively.

In the embodiment shown in FIG. 3, the parallel sets of rollers A, B, C, D are shown, in which each of the rollers 2*a*, 2*b*, 2*c*, etc. in set A is offset relative to a corresponding one of the rollers 12*a*, 12*b*, 12*c*, etc. in set B, which in turn is offset relative to a corresponding one of the rollers 22*a*, 22*b*, 22*c*, etc. in set C. The value for the offset in each case may be set equal to one third the axis-to-axis interval between any two adjacent rollers in sets A, B, C, such as between the adjacent rollers 2*a* and 2*b* in set A, for example.

When the rollers in the sets A, B, C and D are then viewed from the side in FIG. 4(*a*), the roller 12*a* in set B and the roller 22*a* in set C may appear between the rollers 2*a* and 2*b* in set A. Thus, the gap S defined on the top between the corresponding rollers in immediately adjacent sets may become smaller than that shown in FIG. 2(*a*), as viewed from the side in FIG. 4(*a*).

FIG. 3 and FIG. 4(*a*) illustrate the embodiment in which the gap S may be reduced further, when it is compared with the gap in the embodiment shown in FIG. 1 and FIG. 2(*a*). According to this embodiment in FIG. 3 and FIG. 4(*a*), it is found that articles may be moved with less friction and less noise.

In the embodiment shown in FIG. 1 and FIG. 2(*a*), and in the embodiment shown in FIG. 3 and FIG. 4(*a*), four parallel sets of rollers A, B, C, D are provided, but the present invention may be implemented by providing any other number of parallel sets of rollers, such as two sets of rollers, three sets of rollers, five sets of rollers, six sets of rollers etc.

Although the present invention has been described with reference to the particular embodiments thereof, it should be understood that the present invention should not be limited to those embodiments, but various changes and modifications may be made without departing from the spirit and scope of the invention as defined in the appended claims.

What is claimed is:

1. A showcase assembly unit for a showcase structure, comprising:

a roller support frame having a rear end and a front end; and parallel sets of rollers mounted on said roller support frame, wherein each of the rollers of each of said parallel sets (i) is rotatably mounted to said roller support frame and arranged one after another from the rear end of said roller support frame to the front end of said roller support frame, (ii) is axially offset relative to a corresponding roller of an immediately adjacent one of said parallel sets in a direction from the rear end of said roller support frame to the front end of said roller support frame, and (iii) has a width that is less than a bottom dimension of a commercial article that is to be supported by the rollers such that when a plurality of the commercial articles are supported by the rollers the commercial articles extend across at least two of said parallel sets and can be moved one by one along the rollers from the rear end of said roller support frame to the front end of said roller support frame, and wherein said roller support frame includes a lower bearing segment and an upper bearing segment mounted on said lower bearing segment, said lower bearing segment having a flat upper surface for supporting a rotary shaft of each of the rollers of each of said parallel sets such that the rotary shafts can be maintained co-planar with one another, and said upper bearing segment having recesses in a lower side that faces said flat upper surface for receiving therein the rotary shafts.

2. The showcase assembly unit according to claim 1, wherein each of the rollers of each of said parallel sets is axially offset relative to a corresponding roller of an immediately adjacent one of said parallel sets in the direction from the rear end of said roller support frame to the front end of said roller support frame by a distance that is equal to from one half to one fourth of the interval between axes of two immediately adjacent rollers of any of said parallel sets as measured in the direction from the rear end of said roller support frame to the front end of said roller support frame.

3. The showcase assembly unit according to claim 2, wherein said recesses in the lower side of said upper bearing segment each has a depth that is at least equal to a diameter of the rotary shafts, and also has a curved bottom to conform to an outer peripheral surface of the rotary shafts.

4. The showcase assembly unit according to claim 1, wherein said recesses in the lower side of said upper bearing segment each has a depth that is at least equal to a diameter of the rotary shafts, and also has a curved bottom to conform to an outer peripheral surface of the rotary shafts.

* * * * *